US012661545B2

(12) United States Patent
Nolan et al.

(10) Patent No.: US 12,661,545 B2
(45) Date of Patent: Jun. 23, 2026

(54) GLUTE HAMSTRING DEVELOPER EXERCISE MACHINE

(71) Applicant: Bulletproof Fitness Equipment Inc, Acton, CA (US)

(72) Inventors: Lawrence R. Nolan, Santa Clarita, CA (US); Nicole K. Nolan, Santa Clarita, CA (US)

(73) Assignee: Bulletproof Fitness Equipment Inc, Acton, CA (US)

( * ) Notice: Subject to any disclaimer, the term of this patent is extended or adjusted under 35 U.S.C. 154(b) by 111 days.

(21) Appl. No.: 18/664,471

(22) Filed: May 15, 2024

(65) Prior Publication Data

US 2025/0352842 A1 Nov. 20, 2025

(51) Int. Cl.

| | |
|---|---|
| ***A63B 21/06*** | (2006.01) |
| ***A63B 21/00*** | (2006.01) |
| ***A63B 21/072*** | (2006.01) |
| ***A63B 23/02*** | (2006.01) |

(52) U.S. Cl.

CPC ..... *A63B 21/0615* (2013.01); *A63B 21/0726* (2013.01); *A63B 21/4011* (2015.10); *A63B 23/0233* (2013.01)

(58) Field of Classification Search

CPC ..... A63B 21/0615; A63B 21/0616

See application file for complete search history.

(56) References Cited

U.S. PATENT DOCUMENTS

| | | | | |
|---|---|---|---|---|
| 4,747,594 | A * | 5/1988 | Houde | A63B 21/1681 482/904 |
| 7,608,020 | B2 * | 10/2009 | Mason | A63B 21/4005 482/97 |
| 9,630,055 | B2 * | 4/2017 | Runyan | A63B 21/00047 |
| 10,420,974 | B2 * | 9/2019 | Henninger | A63B 23/0211 |

OTHER PUBLICATIONS

Hardcorefitlarry, PCD (Posterior Chain Developer), Published: Nov. 16, 2022, <URL: https://www.instagram.com/reel/CICg7-arHJ2/> ( Year: 2022).*

* cited by examiner

*Primary Examiner* — Zachary T Moore
(74) *Attorney, Agent, or Firm* — AVEK IP, LLC

(57) ABSTRACT

A glute hamstring developer exercise machine includes a vertical post extending from a lower end to an upper end; a user body support system coupled to the vertical post, the user body support system having one or more pads to support the user in a plurality of positions; and a primary frame supporting the one or more pads and extending substantially from the vertical post; at least one weight arm positioned substantially underneath the one or more pads, the at least one weight arm is to be operated by the user to perform one or more exercises.

20 Claims, 6 Drawing Sheets

GLUTE HAMSTRING DEVELOPER EXERCISE MACHINE

FIELD OF INVENTION

The disclosure relates generally to exercise equipment. More specifically, the disclosure relates to a glute hamstring developer exercise machine, having a plurality of adjustable components and a plurality of removable accessories, allowing for the machine to be used for diverse exercises.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

According to an embodiment of the current disclosure, the invention includes a glute hamstring developer exercise machine having a vertical post extending from a lower end to an upper end; a user body support system coupled to the vertical post and having one or more pads to support the user in a plurality of positions; and one or more primary framing components supporting the one or more pads and extending substantially away from the vertical post. At least one weight arm is positioned substantially underneath the one or more pads and is configured to be operated by the user to perform one or more exercises.

BRIEF DESCRIPTION OF THE DRAWINGS

Embodiments of the invention are described in detail below with reference to the attached drawings.

LIST OF REFERENCE NUMBERS

Figure 1:
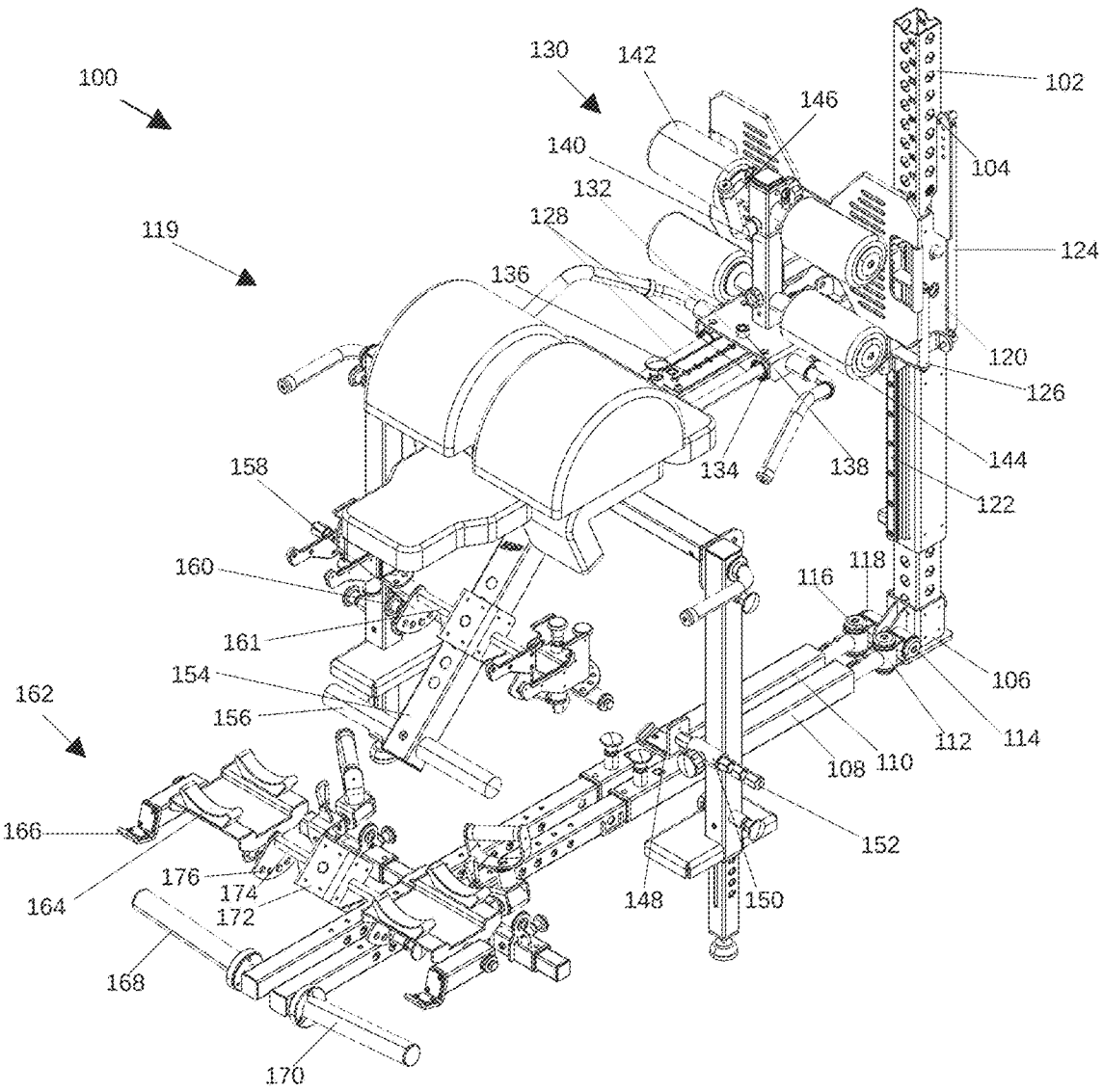
FIG. 1 is a front angled view of a glute hamstring developer exercise machine in accordance with a first embodiment of the present invention.
Figure 2:
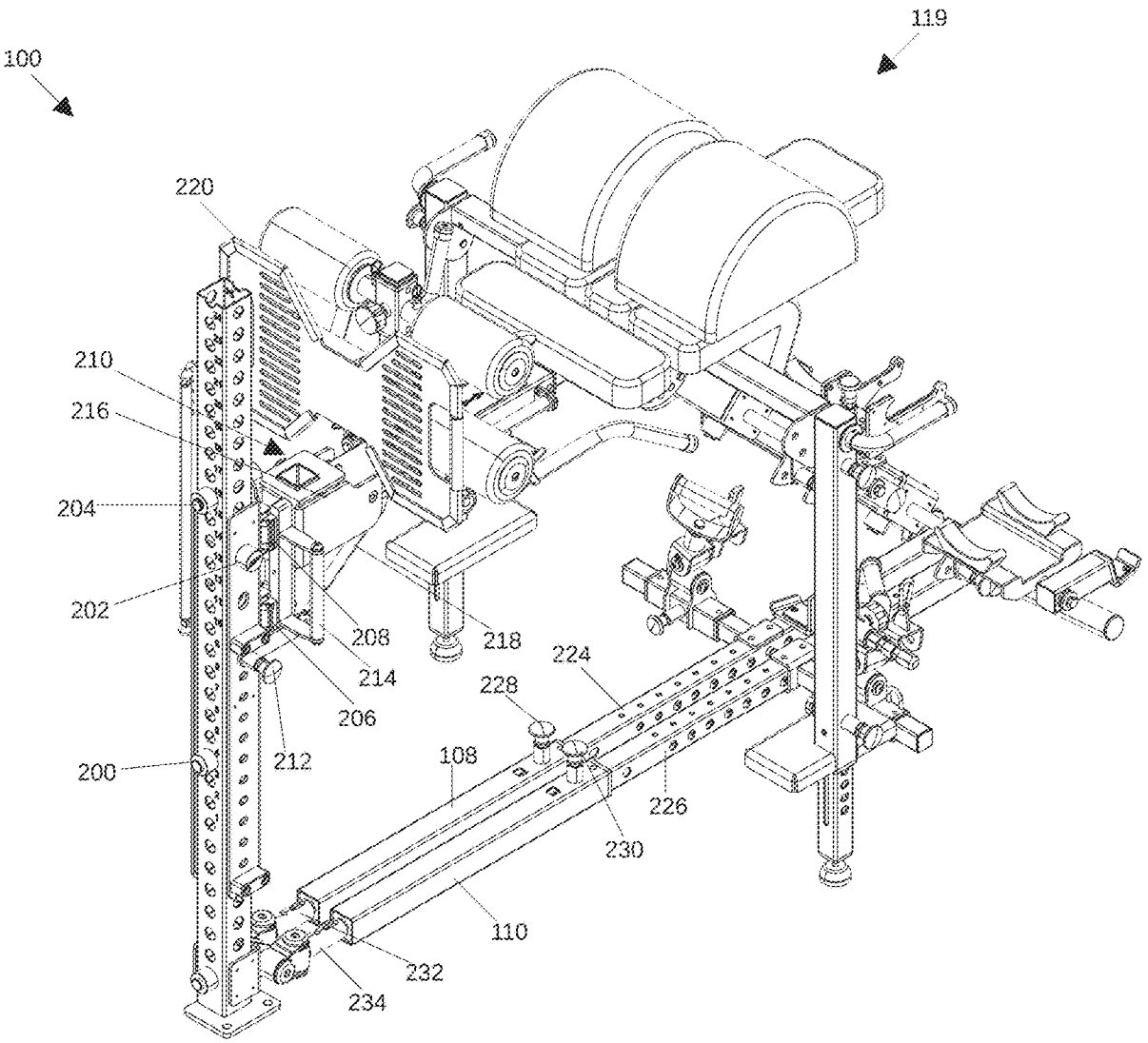
FIG. 2 is a rear angled view of the machine of FIG. 1.

100—Glute Hamstring Developer Exercise Machine
102—Vertical Post
104—Aperture(s)
106—Bottom Bracket
108—First Length Adjustable Weight Arm
110—Second Length Adjustable Weight Arm
112—First Y-Axis Hinge
114—First X-Axis Hinge
116—Second Y-Axis Hinge
118—Second X-Axis Hinge
119—User Body Support System
120—Vertical Bracket
122—Linear Guide Rail

124—Gas Spring
126—Handle
128—Primary Framing Components
130—Foot/Ankle Pad Assembly
132—Base Plate
134—Linear Bearing
136—Guide Plate
138—Locking Pin
140—Vertical Member
142—Upper Pad(s)
144—Lower Pad(s)
146—Handle
148—Weight Arm Shelf
150—Hex Port
152—Hex Shaft
154—Fixed Reverse Hyper Arm
156—Weight Bars
158—Adjustment Plate
160—Locking Pin
161—Member
162—Secondary Dumbbell Attachment
164—Pair of Rubber Bumpers
166—Barbell J-Hooks
168—Weight Bar
170—Weight Bar
172—Bracket
174—Member
176—Adjustment Plate
200—Lower Pin
202—Middle Pin
204—Upper Pin
206—First Linear Guide Block
208—Second Linear Guide Block
210—Trolley Assembly
212—Spring Loaded Pin
214—Handle
216—Main Bracket
218—Bottom Gas Spring
220—Base Platform
224—First Extension Arm
226—Second Extension Arm
228—Locking Pin
230—Locking Pin
232—First Z-Axis Rotation Connection
234—Second Z-Axis Rotation Connection
300—Gas Spring
302—Pull Pin
304—Accessory Attachment Insert
306—Mid-Point Pad
308—Handle
310—Angle Adjustment Plate
312—Pull Pin
314—Handle Assembly
316—Horizontal Member
318—Handle
320—Carriage
322—Locking Pin
324—First Hinged Connection
326—Second Hinged Connection
328—Third Hinged Connection
400—First Angled Handle
402—Second Angled Handle
404—Dual Purpose Upper Thigh Pad/Preacher Curl Pad
406—Thigh Pad
407—Main Body Pads
408—Spring Loaded Pin
410—Leg Support

412—Step Up Plate
414—Spring Loaded Pin
416—Extension Leg
418—Threaded Leveling Mount
420—Spring Loaded Pin
422—Angle Adjustment Plate
423—Cross Bar
424—Barbell/Dumbbell Stand Attachment
426—J-Hook
428—Locking Pin
430—Adjustment Plate
432—Locking Pin
600—Trolley Housing
602—Glide Wheels
604—Twist Lock Plunger Pin The drawings do not limit the invention to the specific embodiments disclosed and described herein. The drawings are not necessarily to scale, emphasis instead being placed upon clearly illustrating various principles of the disclosure.

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Exercise equipment is well known in the art and varies from complex machinery to simple devices. It is generally desirable for both gyms and individuals (home gyms) to maximize floor space. Accordingly, equipment that provides for multiple muscle group activations is preferrable over single use equipment. In other words, a machine that can provide for a plurality of exercises is generally preferable over a machine that can only be utilized for one or merely a few exercises. One conventional type of machine is a glute hamstring developer (GHD), which offers strict focus on developing the glutes and hamstrings through specialized exercises, such as the glute-ham raise, while offering secondary development of relative muscle groups including light lower back conditioning, through back extension movements, and abdominal conditioning. These conventional designs usually follow a common method—a height-adjustable upper and lower foot/ankle pad assembly horizontally adjustable in distance from a curved seat pad collectively affixed to a central frame. This commonality in design limits exercise functionality to the core movements and muscle groups outlined above. Furthermore, the frame's large footprint is necessary to 1) support various user heights, and 2) allow a wide range of movement necessary to perform core functions.

The present invention provides for a glute hamstring developer exercise machine that is configurable into a plurality of different operational modes, with a plurality of different attachments, thereby allowing for a user to operate the machine in many ways to diversify their workout with just one machine. The machine of the present invention is not limited to just glute and hamstring development of conventional GHD machines, but rather combines the core functions of a GHD machine, with added ranges of movement and additional exercise variations that target various upper and lower body muscle groups impossible to perform with a standard GHD and all within a similar footprint.

The machine of the present invention, as will be explained below, provides for: (1) the ability to add and remove portions of the machine to accommodate various exercises and functions outside the scope of a typical GHD, including but not limited to the use of barbells and dumbbells; (2) the ability to adjust the angle of the user support of the machine (from 0 to 45 degrees), thus combining the benefits of a standard GHD with its angled variants (i.e. 45 Degree Back Hyperextension units); (3) the combination of a reverse hyper machine dual purposed to support the placement of barbells and dumbbells, exponentially increasing exercise variations and general functionality; (4) an efficiently utilized footprint that combines exponentially more exercise possibilities when compared to a GHD, Reverse Hyper Machine, and bench, respectively; (5) the addition of dual weight arms for added range of motion and exercises; (6) a unique pad system that combines multiple pad positions into 2 assemblies with dual purposes, including preacher curls and reverse hyper.

In FIGS. 1 through 5 depict a first embodiment of a glute hamstring developer exercise machine 100 in accordance with the present invention. For simplicity, in some views, only one side of the machine is labeled, however, those skilled in the art will readily recognize that a mirror image or second components, albeit not labeled, is/are also included as part of the assembly. The machine 100 combines known/conventional movements of a glute hamstring developer exercise machine, along with additional exercises/movements that allow for targeting many muscle groups by making various adjustments and adding accessories to the machine 100, as explained herein.

The machine 100 includes a vertical post 102 with a plurality of apertures 104 extending vertically along the post 102. The post 102 may be a stand-alone post, or part of a larger exercise system, such as a squat rack, and may be manufactured specifically for the machine 100 or purchased/manufactured separately. The vertical post may vary in size, such as being a standard size selected from 2"×2", 2"×3" or 3"×3". A bottom bracket 106 is attached to the bottom/base end of the vertical post 102 and provides for connection to first and second length adjustable weight arms 108, 110. The bracket 106 and weight arms 108, 110 can vary, but regardless provide for substantially horizontal bars that extend from a substantial base of the vertical post 102 to a position underneath a body support such that the weight arms 108, 110 are configured to be lifted upward to provide weighted resistance to a user positioned there above.

The bracket 106 connects to the arms 108, 110 via three plane rotation connections. Specifically, the arms 108, 110 are configured such that they can pivot in the X/Y/Z axes as the user lifts and manipulates the arms, essentially providing free movement of the arms. This may be achieved in various ways, however, in at least some embodiments, the first weight arm 108 is connected via a first Y-Axis hinge 112, a first X-axis hinge 114, and a first Z-Axis rotation connection 232. Similarly, the second arm 110 is connected via a second Y-Axis hinge 116, a second X-Axis Hinge 118, and second Z-Axis rotation connection 234. This allows for the arms to each pivot from side to side, pivot up and down, and rotate around the Z-axis connections.

The weight arms 108, 110 are length adjustable via any means known in the art. For example, a first extension arm 224 and a second extension arm 226 are insertable and slidingly engaged such that locking pins 228, 230 will lock the arms 108, 110 at desired lengths. This feature allows for the machine 100 to easily be adaptable to users of various heights and arm lengths. The weight arms 108, 110 extend from the bracket 106 to a weight end, wherein a weight bar 168, 170 is positioned on each respective arm 108, 110. The weight bars 168, 170 allow for a user to add weight and increase or decrease the resistance of the arms.

A user body support system 119 is primarily supported by the vertical post 102 and provides for support of the user's body in a plurality of positions, such that the user can operate the machine. The user body support system 119 is attached to the vertical post 102 via a vertical bracket 120 which secures directly to the post 102 via a number of pins, for example a lower pin 200, a middle pin 202, and an upper pin 204. The type of pins may vary, such as being welded pins, removable pins, or spring loaded pins, and inserted from a plurality of sides. The vertical bracket 120 is a C-bracket shaped and sized appropriate to attach to the vertical post 102.

A linear guide rail 122 is attached to, such as via bolts, and runs along a front surface of the vertical bracket 120 and allows for a main trolley assembly 210 to adjust vertically along the bracket 120 via first and second linear guide blocks 206, 208. This allows for sliding height adjustments from 0" (0 mm)-19.6" (500 mm) relative to the bracket's base point. More specifically, a main bracket 216 is directly mounted to the guide blocks 206, 208 such that the main bracket 216 and therefore the trolley assembly 210 can glide along the linear guide rail 122. One or more handles 126, 214 extend from the assembly 210 to aid in vertical adjustment by the user. One or more spring loaded pins 212 are utilized to lock the trolley assembly 210 at a vertical height along the linear guide rail 122 by inserting into a selected one of a series of vertical pin holes on the left face of the vertical bracket 120. A gas spring 124, or an alternative resistance device, is also mounted to the vertical bracket 120 and coupled to the trolley assembly 210 such that a weight load is reduced as a user lifts or lowers the user body support system 119. In other words, the gas spring 124 provides a lifting counterweight such that a user does not have to physically lift the entire weight of the system 119 when making adjustments. Although the gas spring may vary, in embodiments it is a 19.6" (500 mm) stroke gas spring bolted to the right face of the vertical bracket via an extension flange.

A pair of bottom gas spring 218, 300 are coupled from the main trolley assembly 210 to primary framing components 128 such that additional lifting resistance is provided to reduce a weight load to the user during angle adjustment of the user body support system 119. The primary framing components 128, and the entire user body support system 119, can pivot between a horizontal position and a 45-degree angle position with the bottom gas springs 218, 300 providing support during this adjustment. A locking pin 302 locks the user body support system 119 at either 0 or 45 degrees. In embodiments, the trolley assembly 210 also includes an accessory attachment insert 304 which allows for a post of an accessory to attach thereto. The insert 304 is a square or rectangular port/opening that allows for insertion of a corresponding post of an accessory.

The user body support system 119 is coupled to the main trolley assembly 210 via primary framing components 128. The primary framing components 128 extend substantially horizontal relative to the ground surface (when in the 0 degree configuration) and support a foot/ankle pad assembly 130 and a plurality of pads. The foot/ankle pad assembly 130 has a base plate 132 mounted on linear bearings 134 which are then directly coupled to the primary framing components 128 such that the foot/ankle pad assembly 130 can move forward and backward. The linear bearings 134 allow for the base plate 132 to adjust along a guide plate 136 and lock into place via a locking pin 138, again allowing for the foot/ankle pad assembly 130 to adjust to fit users of different heights.

A vertical member 140 extends upward from the base plate 132 and supports a pair of upper pads 142 and a pair of lower pads 144. A handle 146 is coupled to the vertical member 140 for use in adjusting the foot/ankle pad assembly 130 forward and backward as well as to aid the user in positioning their body for a desired exercise. A base platform 220 is also attached to the base plate 132 to provide a surface for engagement by a user's feet during various exercises. For example, when the user body support system 119 is positioned at the 45 degree angle, the user can stand on the base platform 132. Outwardly angled handles 400, 402 extend from the base plate 132 and provide hand placement for reverse hyper functions.

Figure 3:
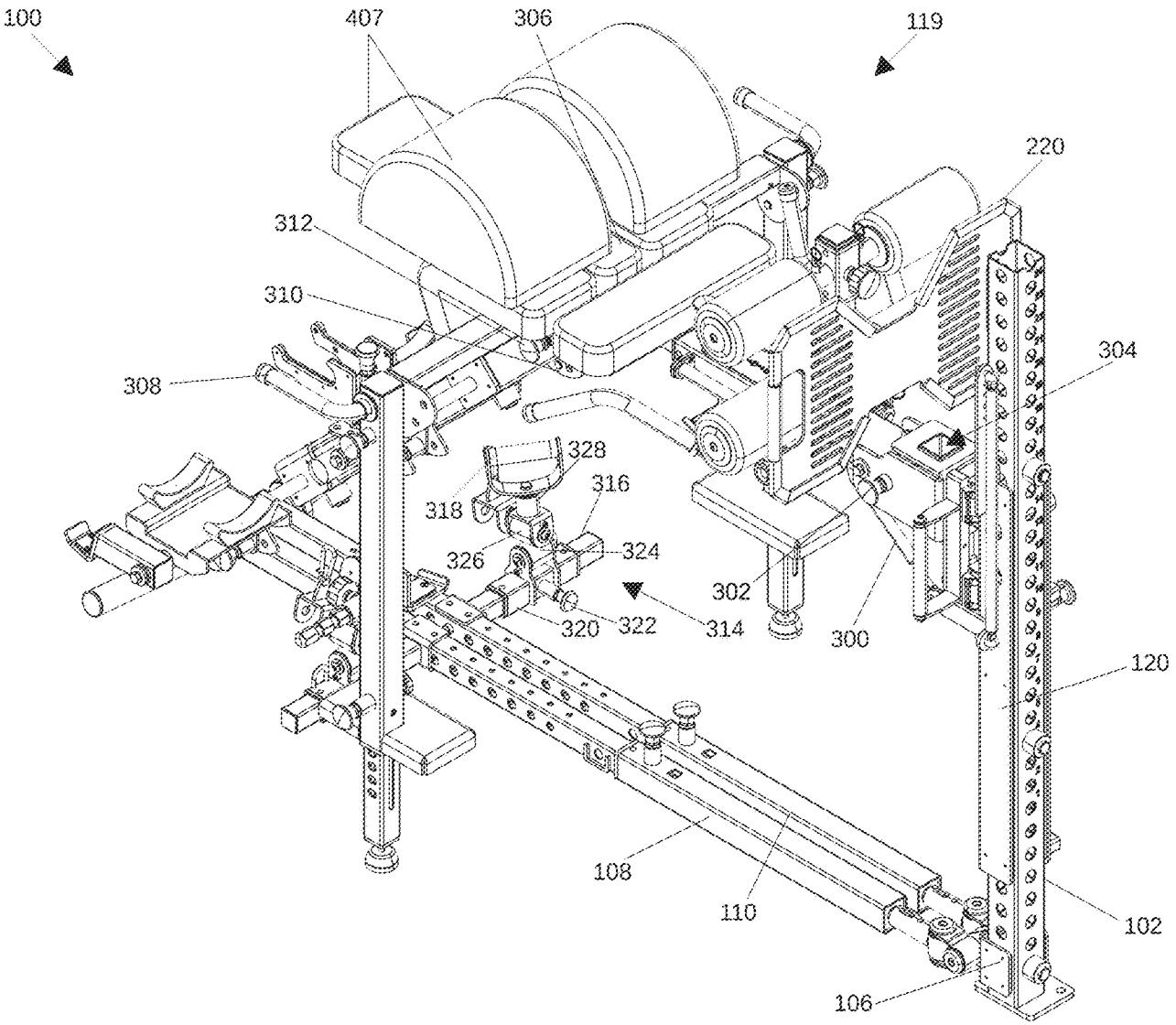
FIG. 3 is another rear angled view of the machine of FIG. 1.
Figure 4:
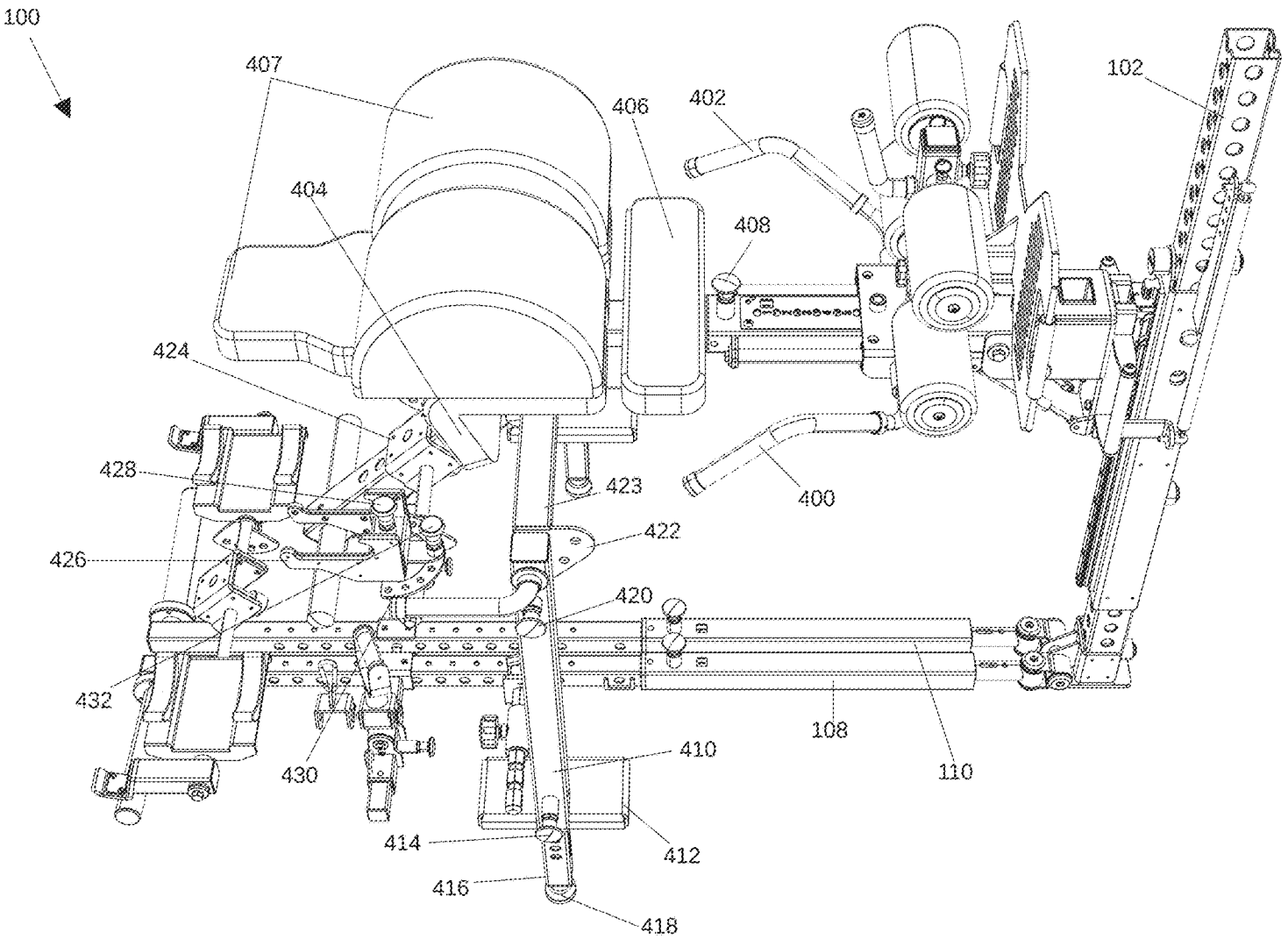
FIG. 4 is a side perspective view of the machine of FIG. 1.
Figure 5:
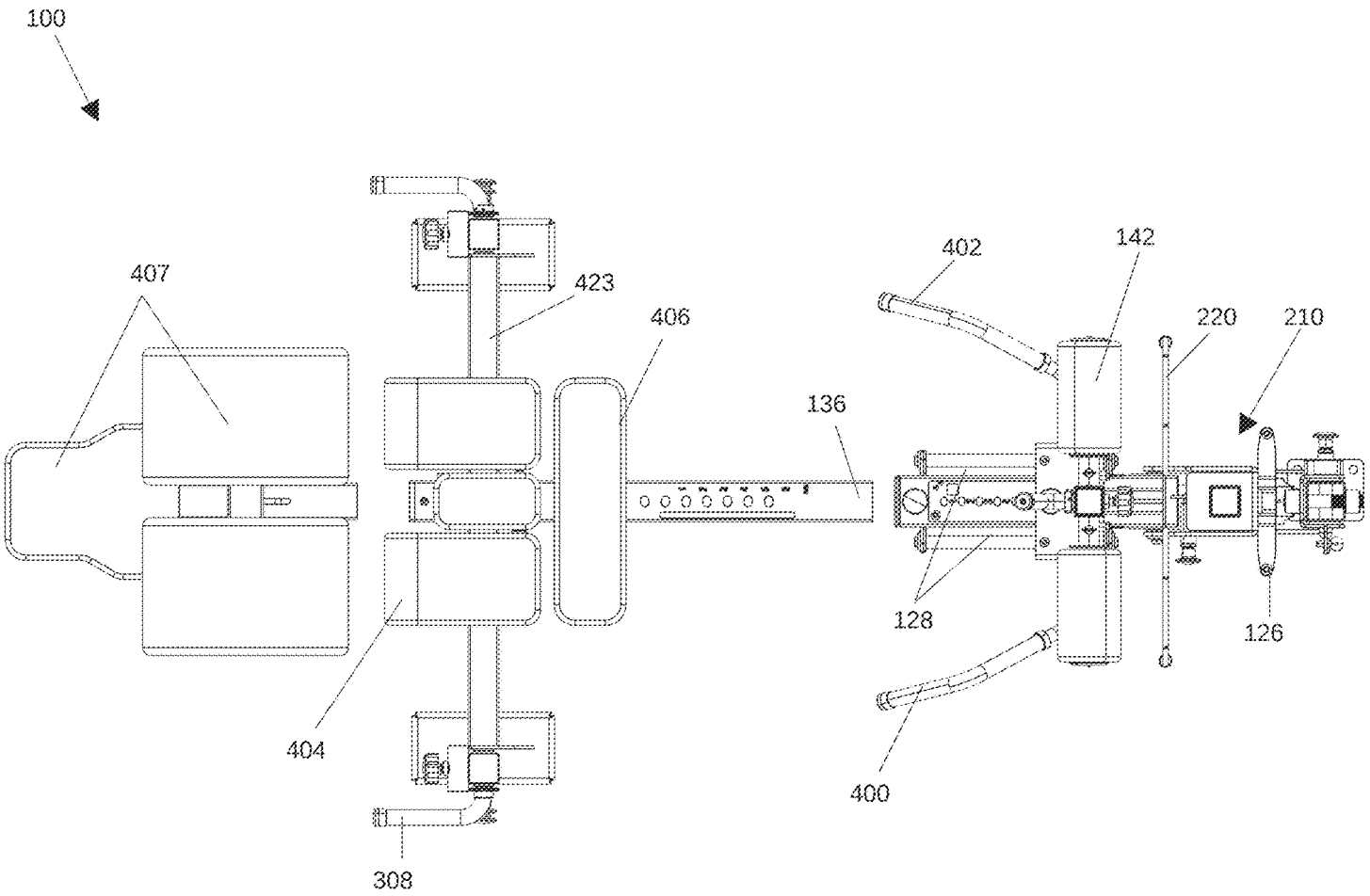
FIG. 5 is a top disassembled view of the machine of FIG. 1.

As best shown and labeled in FIG. 4. The machine 100 includes a plurality of pads which allow a user to be supported in a plurality of positions, as needed. The pads are removable. This includes, among others, a dual-purpose upper thigh pad/preacher curl pad 404, a thigh pad 406, main body pads 407, and a mid-point pad 306 (see FIG. 3). Another spring-loaded pin 408 allows for the pad assembly to be removed. The user can utilize the pads as needed such that the following exercises, as well as others, can be performed: glute-ham raises, sit ups, back raises, sit ups with hip flexion, side bends, reverse knee curls, horizonal trunk twists, and inversions. The addition of the angled preacher pad adds additional exercise variations, including but not limited to prone preacher curls (when the unit is flat) or standing preacher curls (when the unit is positioned at 45 degrees).

Best shown in FIGS. 1 and 4, a fixed reverse hyper arm 154 extends below the pads and is attached to a crossbar 423 via an angle adjustment plate 310 and a twist lock pull pin 312, which allows the arm 154 to swing freely or lock at a specific angle with 0-180 degrees of variability. When the pin is disengaged, the arm 154 swings freely, and users can apply weight plates to weight bars 156 and attach a reverse hyper strap to the arm to perform a reverse hyper function. The fixed reverse hyper arm 154 supports a barbell/dumbbell stand attachment 424 coupled to the arm 154 via a bracket and having two pairs of J-hooks 426 for supporting a barbell or dumbbell. In other words, as the user is supported by the pads, the user can access and lift a barbell or dumbbell resting within the two pairs of J-hooks 426. This allows for a user to perform barbell/dumbbell prone rows and seal rows, or inclined dumbbell rows. The J-hooks 426 are adjustable in a plurality of planes. Specifically, a first locking pin 428 locks the J-hooks 426 in place. A first adjustment plate 430 and another locking pin 432 allow the pair of J-hooks 426 to rotate from side to side. As shown in FIG. 1, another adjustment plate 158 with a locking pin 160 couple the J-hooks 426 to a member 161 such that the J-hooks 426 can rotate up and down. As desired, the barbell/dumbbell stand attachment 424 can be completely removed from the fixed reverse hyper arm 154.

A secondary dumbbell attachment 162 can be attached to the fixed reverse hyper arm 154. This attachment 162 also includes a bracket 172 for slidingly engaging and securing to the fixed reverse hyper arm 154, but is dimensionally larger and offers a wider shelf area for heavier and dimensionally larger dumbbell weights. Here, a member 174 extend out from the bracket 172 and couples to an adjustment plate 176. This allows for a pair of rubber bumpers 164 to adjust about the adjustment plate 176. This attachment 162 also includes barbell J-hooks 166 positioned outside of the rubber bumpers 164.

FIG. 3 further depicts a handle assembly 314. As stated above, although only one side is labeled in the illustrations, those skilled in the art will easily be able to correlate the features to the second, non-labeled side of the illustrations, understanding that two handle assemblies are included. The handle assembly 314 includes a horizontal member 316 for attaching to and extending away from an associated one of the adjustable weight arms 110. A handle 318, which can vary in style and aesthetics, is attached to the horizontal member 316 via a carriage 320 and locking pin 322. Here, three hinged connections 324, 326, 328 allow for the handle 318 to have full rotation and movement such that the handle is essentially free moving. During at least some exercises, the user will lie on the support system, wherein they reach down and grab the handles and lift up to activate muscle groups.

As best shown in FIG. 4, a leg support 410 (on each side) extends from the crossbar 423 to the ground surface, providing additional support and step-up assistance to the user body support system 119. The leg support 410 is adjustable in angle via an angle adjustment plate 422 and a spring-loaded pin 420, allowing for adjustability to 0 degrees (for storage), 45 degrees for incline-positioned functions, or 90 degrees positioning the frame parallel to the ground plane. A step-up plate 412 is attached to the leg support 410 to aid a user in climbing up to the user body support system 119. An extension leg 416 allows for heigh adjustability via a spring-loaded pin 414 and a threaded leveling mount 418 extends from the leg such that the system can be supported evenly on uneven ground. A handle 308 allows for a user to easily rotate the associated leg support 410 to one of the three angled positions.

Also attached to the leg support 410 is a weight arm shelf 148 attached via a hex port 150 and hex shaft 152. The use of a hex port 150 and hex shaft 152 combination ensures a tight lock on the connection between the two. The weight arm shelf 148 provides a location for the associated weight arm 108 to rest when in use. In other words, the user will begin lifting the weight arms 108, 110 and, as needed, rest the weight arms in their associated shelf such that they are easier to grasp later.

Figure 6:
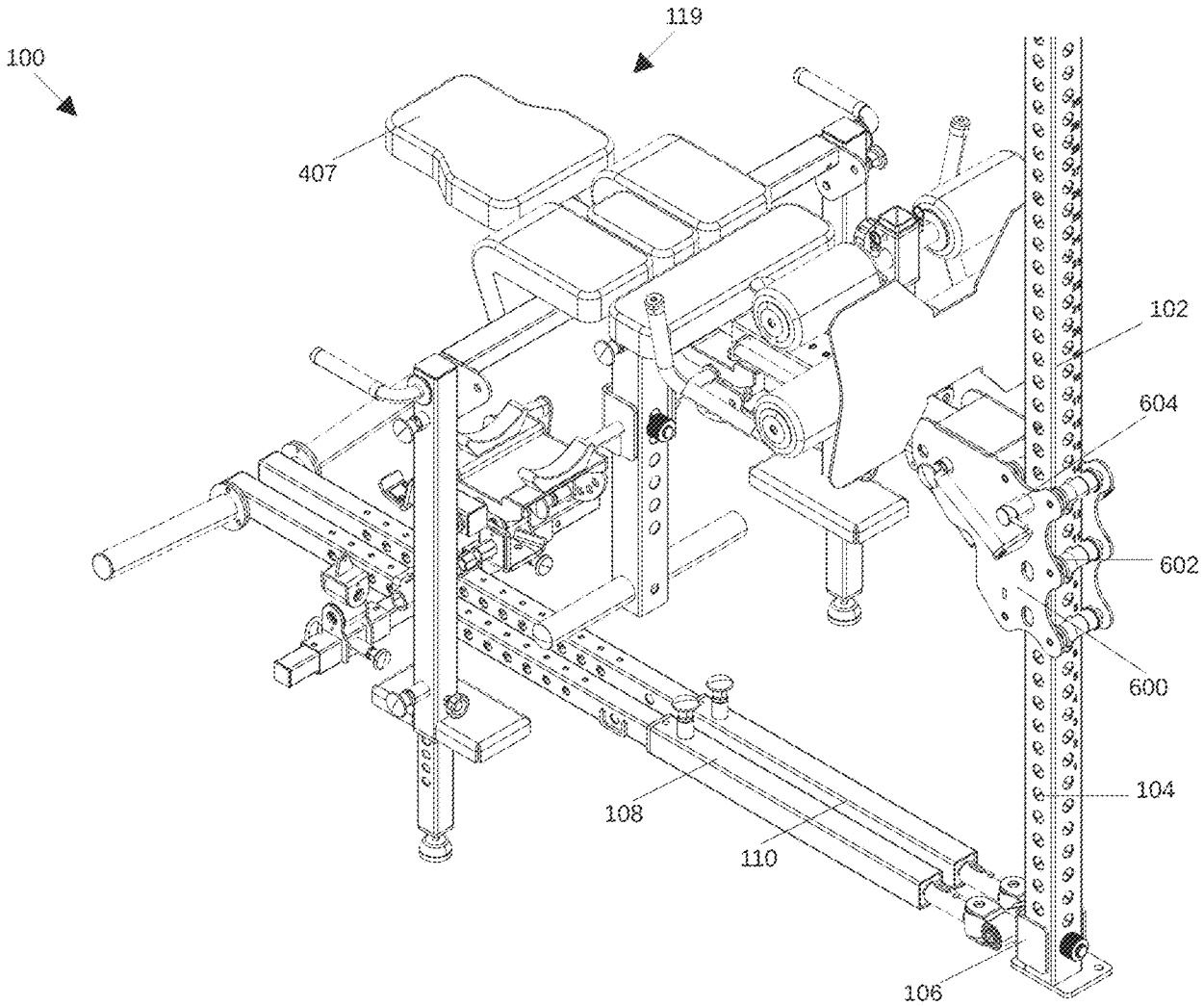
FIG. 6 is a rear angled view of a glute hamstring developer exercise machine in accordance with a second embodiment of the present invention.

In FIG. 6 an alternative embodiment of the glute hamstring developer exercise machine 100 is shown having all or substantially all of the features discussed above. Here, an alternative trolley housing 600 is shown, wherein a plurality of glide wheels 602 allow for the trolley housing 6500 to traverse along the vertical post 102 and lock into tone of the apertures via a twist lock plunger pin.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

The invention claimed is:

1. A glute hamstring developer exercise machine, comprising:

a vertical post extending from a lower end to an upper end;

a user body support system coupled to the vertical post, the user body support system having:

one or more pads to support the user in a plurality of positions; and a primary frame supporting the one or more pads and extending substantially from the vertical post;

at least one weight arm positioned substantially underneath the one or more pads, the at least one weight arm configured to be operated by the user to perform one or more exercises;

a vertical bracket connected to the vertical post via one or more locking pins;

a linear guide rail attached to the vertical bracket;

at least one linear guide block coupled to the linear guide rail and configured to traverse along the linear guide rail; and a trolley assembly attached to the at least one linear guide block such that the trolley assembly can traverse along the linear guide rail via the at least one linear guide block;

wherein the primary frame is attached to the trolley assembly such that the user body support system is configured to move with the trolley assembly.

2. The glute hamstring developer exercise machine of claim 1, further comprising:

a bottom bracket positioned on the lower end of the vertical post;

the at least one weight arm includes:

a first weight arm coupled to the bottom bracket via a first hinged connection, a second hinged connection and a third hinged connection, the first, second, and third hinged connections allowing the first weight arm to move within three planes during operation; and a second weight arm coupled to the bottom bracket;

wherein the first weight arm and the second weight arm are length adjustable and extend from the bottom bracket to a weight receiving end; and wherein the first weight arm and the second weight arm are configured to be lifted by the user as the user is supported by the user body support system.

3. The glute hamstring developer exercise machine of claim 1, further comprising a reverse hyper bar extending downward from the user body support system, the reverse hyper bar having a handle configured for operation by the user.

4. The glute hamstring developer exercise machine of claim 3, further comprising a bar and dumbbell stand attachment coupled to the reverse hyper bar, the bar and dumbbell stand attachment having a first pair of hooks and a second pair of hooks, the first pair of hooks and the second pair of hooks configured to support a bar or dumbbell.

5. The glute hamstring developer exercise machine of claim 4, wherein the bar and dumbbell stand attachment further comprises:

a bracket attached to the reverse hyper bar;

a first member extending from the bracket and supporting the first pair of hooks, the first pair of hooks coupled to the first member via an adjustment plate such that the first pair of hooks is adjustable in a first plane; and a second member extending from the bracket and supporting the second pair of hooks.

6. The glute hamstring developer exercise machine of claim 5, wherein the first pair of hooks is further coupled to the first member via a second adjustment plate such that the first pair of hooks is adjustable in a second plane.

7. The glute hamstring developer exercise machine of claim 3, further comprising a secondary dumbbell attachment having a bracket configured to couple the secondary dumbbell attachment to the reverse hyper bar, the secondary dumbbell attachment further having:

a first member extending from the bracket;

an adjustment plate attached to the first member;

a first pair of bumpers coupled to the adjustment plate and the first member such that the first pair of bumpers is configured to be selectively positioned via the adjustment plate; and a first hook coupled to the first pair of bumpers.

8. The glute hamstring developer exercise machine of claim 1, wherein the trolley assembly further comprises:

a main bracket mounted to the at least one linear guide block, the main bracket forming an accessory attachment insert configured to receive one or more accessories;

at least one gas spring configured to provide counter force against the user body support system; and one or more handles configured to aid a user in manipulation of the trolley assembly.

9. The glute hamstring developer exercise machine of claim 8, further comprising a vertical gas spring attached to the vertical bracket and configured to provide counterweight against a weight supported by the vertical bracket.

10. The glute hamstring developer exercise machine of claim 1, further comprising a foot and ankle pad assembly coupled to the primary frame.

11. The glute hamstring developer exercise machine of claim 10, wherein the foot and ankle pad assembly further comprises:

a base plate mounted to the primary frame via at least one linear bearing;

a vertical member extending from the base plate;

a pair of upper pads coupled to the vertical member; and a pair of lower pads coupled to the vertical member.

12. The glute hamstring developer exercise machine of claim 11, further comprising a base platform positioned behind vertical member and coupled to the base plate.

13. The glute hamstring developer exercise machine of claim 1, further comprising:

a first leg support extending from a ground surface to the user body support system;

a second leg support extending from the ground surface to the user body support system; and a cross bar extending underneath the user body support system and between the first leg support and the second leg support.

14. The glute hamstring developer exercise machine of claim 13, wherein the first leg support further comprises:

an extension leg configured to extend a length of the first leg support and lock into place via a pin; and a threaded leveling mount positioned on a bottom end of the extension leg.

15. The glute hamstring developer exercise machine of claim 13, further comprising a step up plate attached to the first leg support.

16. The glute hamstring developer exercise machine of claim 13, further comprising a weight arm shelf attached to the first leg support via a hex shaft extending from the weight arm shelf and a hex port attached to the first leg support.

17. The glute hamstring developer exercise machine of claim 1, further comprising at least one handle assembly coupled to the at least one weight arm, the at least one handle assembly having a handle for operation by a user.

18. The glute hamstring developer exercise machine of claim 17, wherein the at least one handle assembly further comprises a carriage configured to adjustably secure at a distance away from the at least one weight arm.

19. The glute hamstring developer exercise machine of claim 18, wherein the handle is coupled to the carriage via a first hinged connection, a second hinged connection, and a third hinged connection such that the handle can move within three planes of movement.

20. A glute hamstring developer exercise machine, comprising:

a vertical post extending from a lower end to an upper end;

a user body support system coupled to the vertical post, the user body support system having:

one or more pads to support the user in a plurality of positions; and a primary frame supporting the one or more pads and extending substantially from the vertical post;

at least one weight arm positioned substantially underneath the one or more pads, the at least one weight arm configured to be operated by the user to perform one or more exercises;

a first leg support extending from a ground surface to the user body support system, the first leg support including:

an extension leg configured to extend a length of the first leg support and lock into place via a pin; and a threaded leveling mount positioned on a bottom end of the extension leg;

a second leg support extending from the ground surface to the user body support system; and a cross bar extending underneath the user body support system and between the first leg support and the second leg support.

* * * * *